US006704970B2

(12) United States Patent
Ebenhoh et al.

(10) Patent No.: US 6,704,970 B2
(45) Date of Patent: Mar. 16, 2004

(54) DEVICE AND METHOD FOR LEVELING CLOTHING ON CARDING MACHINE FLAT BARS

(75) Inventors: Andreas Ebenhoh, Mönchengladbach (DE); Gerd Pferdmenges, Mönchengladbach (DE); Armin Leder, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/218,621

(22) Filed: Aug. 15, 2002

(65) Prior Publication Data

US 2003/0033692 A1 Feb. 20, 2003

(30) Foreign Application Priority Data

Aug. 16, 2001 (DE) ..... 101 40 304

(51) Int. Cl.[7] ..... D01G 15/84
(52) U.S. Cl. ..... 19/114; 19/102; 19/113
(58) Field of Search ..... 19/65 R, 98, 102, 19/104, 105, 108, 110, 111, 112, 113, 114

(56) References Cited

U.S. PATENT DOCUMENTS

| | | | | | |
|---|---|---|---|---|---|
| 524,566 | A | * | 8/1894 | Senior et al. | 19/113 |
| 3,151,362 | A | | 10/1964 | Freitag | |
| 3,737,953 | A | * | 6/1973 | Bechtel, Jr. | 19/113 |
| 3,793,677 | A | * | 2/1974 | Bechtel, Jr. | 19/113 |
| 3,936,911 | A | * | 2/1976 | Roberts | 19/113 |
| 4,221,023 | A | * | 9/1980 | Henderson et al. | 19/113 |
| 4,297,768 | A | * | 11/1981 | Loffler | 19/113 |
| 5,467,505 | A | * | 11/1995 | Graf | 19/114 |
| 5,745,955 | A | * | 5/1998 | Patelli et al. | 19/102 |
| 6,047,446 | A | * | 4/2000 | Leder et al. | 19/102 |
| 6,101,680 | A | * | 8/2000 | Naf et al. | 19/102 |

FOREIGN PATENT DOCUMENTS

| | | |
|---|---|---|
| DE | 745 707 | 3/1944 |
| DE | 25 44 920 A1 | 4/1976 |
| DE | 25 44 517 A1 | 4/1977 |
| EP | 0 195 756 A2 | 9/1986 |
| EP | 0 567 747 B1 | 11/1993 |
| EP | 0 945 531 A2 | 9/1999 |
| GB | 736 287 A | 9/1955 |
| GB | 860 417 A | 2/1961 |
| GB | 1 309 229 A | 3/1973 |
| GB | 2 102 850 A | 2/1983 |

OTHER PUBLICATIONS

Patent Abstract of Japan, JP58186616 A, Oct. 31, 1983 (Abstract and Figure only).

* cited by examiner

*Primary Examiner*—Gary L. Welch
(74) *Attorney, Agent, or Firm*—Venable LLP; Robert Kinberg; Stuart I. Smith

(57) ABSTRACT

A flat bar assembly is provided for use with a carding machine having a carding cylinder, the carding cylinder having clothing. The assembly has a flat bar, flat bar clothing attached to the flat bar, and an equalizing layer between the flat bar and the flat bar clothing. The flat bar clothing is for positioning opposite the carding cylinder clothing, and the equalizing layer fills a space between the flat bar and the flat bar clothing to compensate for distance differences between the flat bar clothing and the flat bar and to locate the flat bar clothing at a predetermined position relative to the flat bar.

28 Claims, 7 Drawing Sheets

DEVICE AND METHOD FOR LEVELING CLOTHING ON CARDING MACHINE FLAT BARS

CROSS-REFERENCE TO RELATED APPLICATION

This application claims the priority of German Patent Application No. 101 40 304.6 filed on Aug. 16, 2001, the disclosure of which is being incorporated herein by reference.

BACKGROUND OF THE INVENTION

The invention relates to a device on a carding machine for cotton, synthetic fibers and the like. More particularly, the invention relates to flat bars with clothing, wherein the flat bars are positioned opposite clothing mounted on a roller, such as, for example, a main carding cylinder.

The flat bar of the device shown in U.S. Pat. No. 3,151, 362 has a back piece and a support body with an underside. A clothing strip is attached to the underside and extends in a longitudinal direction of the flat bar. The clothing strip has a support element with several textile layers having a plurality of wire hooks embedded therein. The clothing strip is attached with at least two clamps extending over the longitudinal sides of the support body. With one end, the clamps encircle the edge regions of the clothing strip in the longitudinal direction while they engage with the other end in recesses of the support body. In practical operations, the clamps are fashioned from sheet-metal strips, one longitudinal edge of which is pushed into the textile material. During assembly, the textile material of the clothing strip is attached with considerable tension and form-fitted to the support body of the flat bar. In the process, the clamps exert tensile forces, such that the textile material is spherically deformed away from the flat bar underside. This results in the clothing wire points being arranged in an undesirable manner pointing outward on a convex enveloping curve. A set of such flat bars has a height fluctuation of, for example, 0.05 mm when not in use. When in use, however, the height differences can increase to approximately 0.2 mm. Re-sharpening the clothing point on the machine only results in an insignificant improvement of the accuracy. Following a throughput of approximately 400 tons of fiber material, the flat bar clothing is worn out to the point that it must be replaced. To dismantle the sheet metal straps, the flat bar is clamped down and the form-fitting connection is reversed with the aid of a lever and pliers. The considerable forces required during the assembly and dismantling negatively affect the dimensional stability of the flat bar. Undesirable production tolerances for the flat bar body compound these dimensional inaccuracies. As a result of the aforementioned disadvantages, the clothing wire points of the clothed flat bar must be leveled by grinding them down.

Modern flat bars are made of aluminum and are extruded. During practical operations, the extruded flat bar is then cut to size and is leveled, for example to within 0.05 mm of flat. Support pins are subsequently glued into openings on the side of the support body, over a partial region in a tolerance-free plane. Height fluctuations for the glued-in pins result due to the extrusion process and the leveling operation. To keep the height difference for a flat bar set to within 0.05 mm of each other, the bars are sorted according to their height following pin gluing. This operation is time consuming. The clothing strip is then mounted to the underside of the flat bar in the above-described manner. The total height difference when adding the tolerances of the flat bar, the flat bar clothing, the offset during assembly, and the deformation caused by tensioning when mounting the clothing is significant. As a result, the previously described leveling grinding is carried out across all the flat bars after assembly. In the process, up to 0.15 mm is ground off, thus reducing the technological effectiveness of the ground-down, clothing wire points. During the grinding-down operation, the actual operational precision in the region of the wire points is removed from the clothing wire. The addition of the tolerances during the assembly of the flat bar clothing, the technologically damaging leveling grinding, and wear during use represent particular disadvantages in these machines.

SUMMARY OF THE INVENTION

Thus, it is an object of particular embodiments of the invention to create a device of the aforementioned type that avoids the above-mentioned disadvantages and, in particular, allows for an easy production of an inherently stable flat bar with clothing.

Embodiments of the invention include a flat bar assembly for use with a carding machine having a carding cylinder, the carding cylinder having clothing. The assembly has a flat bar, flat bar clothing attached to the flat bar, and an equalizing layer between the flat bar and the flat bar clothing. The flat bar clothing is for positioning opposite the carding cylinder clothing, and the equalizing layer fills a space between the flat bar and the flat bar clothing to compensate for distance differences between the flat bar clothing and the flat bar and to locate the flat bar clothing at a predetermined position relative to the flat bar.

An inherently stable flat bar can be produced easily by arranging an equalizing layer between the flat bar and the flat bar clothing to compensate for differences in the distance between the two. All production tolerances of the flat bar, the clothing and those occurring during the assembly (including the dismantling) are compensated for. The clothed flat bar according to the invention advantageously avoids the addition of tolerances resulting from the assembly and dismantling of the flat bar clothing, the technologically damaging leveling grinding and uneven wear during use.

The equalizing layer advantageously equalizes the distance differences between the rear surface of the clothing and the underside of the flat bar. The equalizing layer can preferably locally equalize distance differences between the rear surface and the underside. The flat bar forms a component of a set of traveling flats and is locally secured. A flexible clothing is provided and preferably comprises a support and clothing wire points, wires, hooks or the like. The support is strip-shaped and the clothing preferably consists of sawtooth wire strips, e.g. all-steel clothing. The clothing is attached in the region of the flat bar underside and is preferably glued to the flat bar. The equalizing layer preferably consists of a synthetic material or the like. This equalizing material can be a synthetic resin, such as epoxy resin. Polyester or a similar material is preferred for the equalizing material. The synthetic material, the synthetic resin, or the like should harden and should preferably be pourable. It is furthermore useful if the synthetic material, the synthetic resin, or the like, is adhering and preferably adheres more to the clothing support than to the underside of the flat bar. An adhesive layer can be provided between the equalizing layer and the underside of the flat bar, preferably in the form of an adhesive foil. It is useful if at least one side of the adhesive foil is sticky. The equalizing layer or the adhesive can be detachable and should preferably be watersoluble. A soluble lacquer or the like is preferably provided for the equalizing layer and the adhesive. Preferably, the equalizing layer and the adhesive can be removed without residue from the underside of the flat bar. The underside of the flat bar is preferably provided with an equalizing step. The flat bar and the flat bar clothing can be aligned to the same reference plane, preferably a plane across the tips of the flat bar clothing. It is useful if the flat bar is an extruded profile made of a lightweight metal, e.g. aluminum, and is preferably a hollow profile. The correct length of the flat bar is cut and then preferably leveled. Two end parts (flat bar heads) are preferably aligned at the ends to the support body. These two end parts are preferably pins, made of hardened steel or a similar material, which are fastened in recesses of the support body. The support element (textile material) and the equalizing layer are preferably arranged in a recess on the underside of the flat bar and/or on the support body. The recess can be delimited by at least two ridges along the longitudinal sides of the support body. The support body preferably has inlet openings, e.g. through bores, for filling in the equalizing layer material. It is advantageous if the distance between sliding surfaces of the flat bar heads and a curve defined by the flat bar clothing wire points is the same.

An apparatus to assist the assembly of the flat bar assemblies has a flat plate and a bearing element. The plate is preferably a magnetic plate. The flat bar heads rest on a reference plane, and the plate and the reference plane are preferably attached to the bearing element. Two reference planes are oriented parallel to each other and the distance between these reference planes should be adjustable. It is advantageous if the flat bar clothing points rest on one reference plane, the flat bar heads on the other reference plane and the intermediate layer is inserted between the support body and the clothing strip. An adhesive strip is preferably inserted between the intermediate layer and the underside of the support body. The adhesive strip is preferably sticky on two sides. The support element preferably has at least one fastening plate, for example of metal, which is attached with a screw or the like to the flat bar. The adhesive strip preferably has a shackle or the like. The width of the adhesive strip and the adhesive equalizing layer is preferably wider than the width of the support body, the equalizing layer and/or the support element.

BRIEF DESCRIPTION OF THE DRAWINGS

The invention is explained further in the following description with the aid of exemplary embodiments shown in the drawings, wherein like reference numbers denote like elements, and wherein.

DETAILED DESCRIPTION OF THE INVENTION

Figure 1:
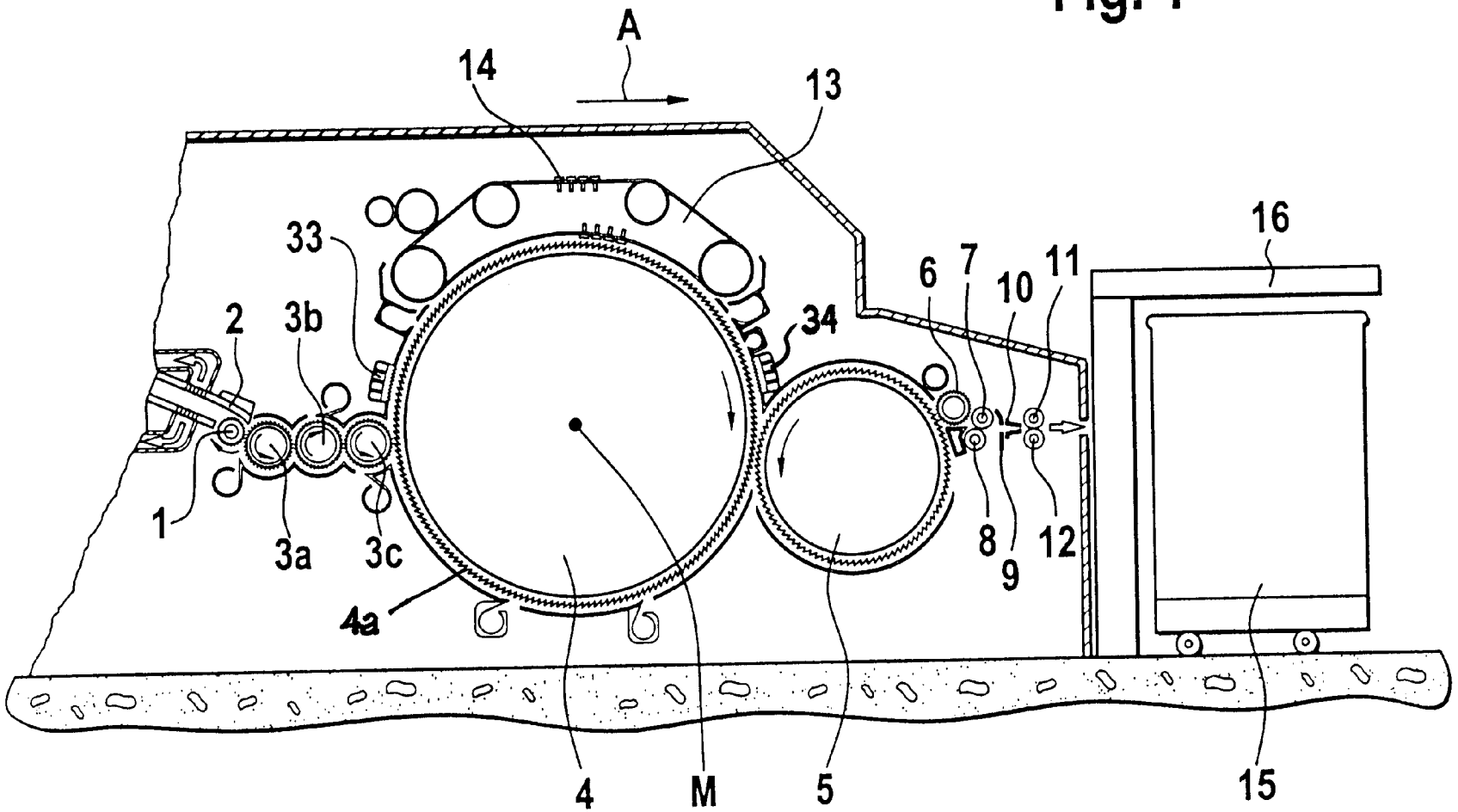
FIG. 1 is a schematic side elevation view of a carding machine provided with a device according to the invention.

FIG. 1 shows a carding machine, for example a high performance carding machine DK 903 by the company Tr ützschler, Mönchengladbach, Germany. The carding machine has feed roller 1, feed table 2, licker-ins 3*a,* 3*b,* 3*c,* main carding cylinder 4, doffer 5, stripping roller 6, crushing rollers 7, 8, sliver guide element 9, web trumpet 10, withdrawing rollers 11, 12, traveling flats 13 with clothed flat bars 14, can 15, and can holder 16. Curved arrows indicate the rotational directions for the rollers while the arrow A refers to the operating direction. The fixed carding elements 33 and 34 are arranged opposite the main carding cylinder clothing 4*a.*

Figure 2:
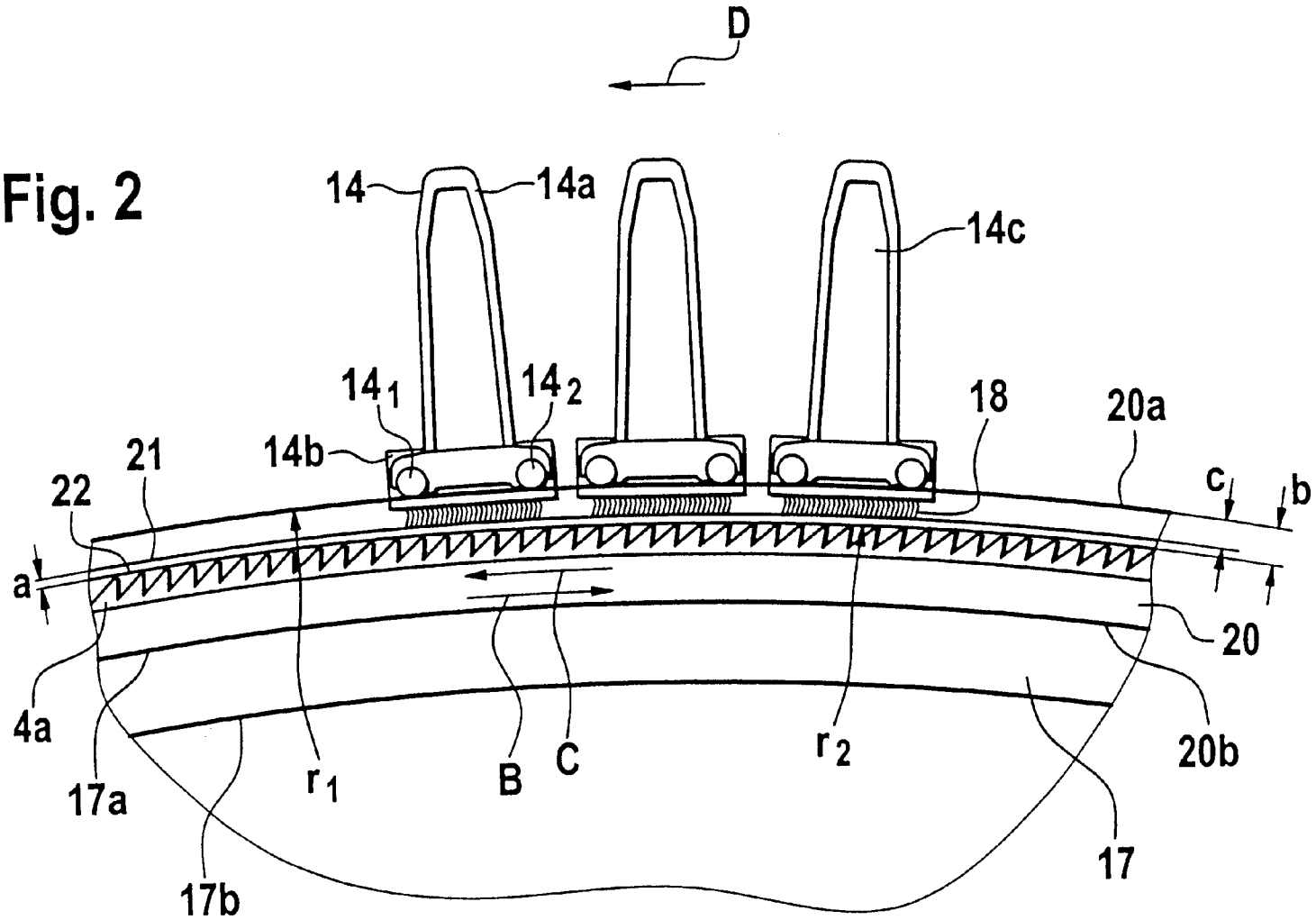
FIG. 2 shows clothed flat bars in accordance with the invention.
Figure 3A:
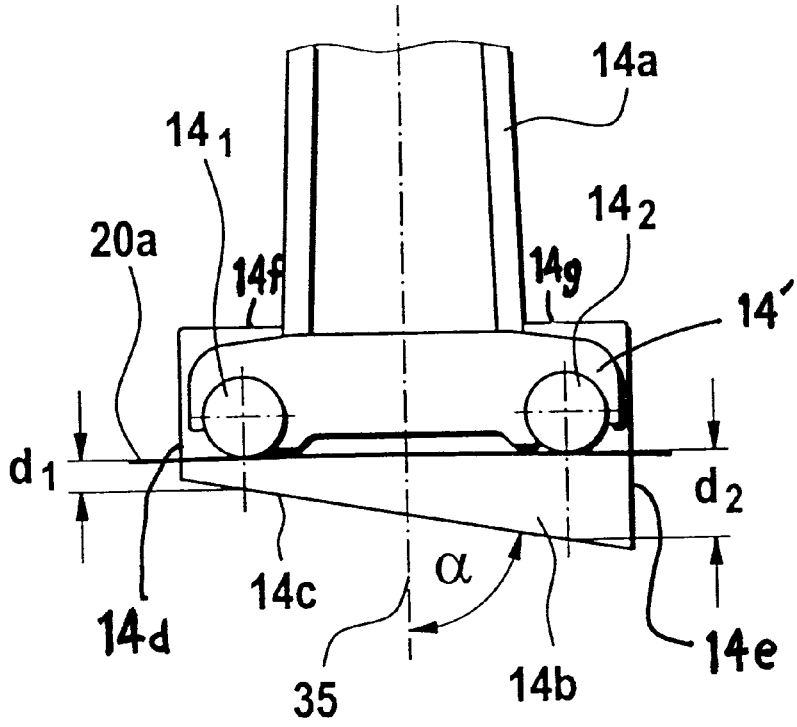
FIG. 3*a* is a side elevation view of a flat bar with a portion of the back piece, the support body and the pins in the flat bar heads.

According to FIG. 2, a flexible bend 17, provided with several adjustment screws (not shown), is mounted on each side of the carding machine on the side of the machine frame. The flexible bend 17 has a convex outer surface 17*a* and a bottom surface 17*b.* A sliding guide 20, made, for example, of a sliding plastic, with convex outer surface 20*a* and concave inner surface 20*b,* is located above the flexible bend 17. The concave inner surface 20*b* rests on the convex outer surface 17*a* and can glide on this surface in the direction of arrows B, C. Each flat bar 14, for example shaped as disclosed in European Patent 0 567 747 A1, has a back piece 14*a* and a support body 14*b.* As shown in FIG. 3*a,* the support body 14*b* has a bottom surface 14*c,* two side surfaces 14*d,* 14*e,* and two upper surfaces 14*f,* 14*g* (see FIG. 3*a*). Each flat bar 14 is provided with one flat bar head 14', 14" on each end (see FIG. 7*b*). Flat bar head 14' has two steel pins $\mathbf{14}_1$, $\mathbf{14}_2$ and flat bar head 14" has two steel pins $\mathbf{14}_3$, $\mathbf{14}_4$. A portion of each pin is fastened (for example, glued) in an axial direction (along length 1 in FIG. 7*b*) in recesses 33*a,* 33*b* of the support body 14*b* (see FIG. 7*b*). The sections of steel pins $\mathbf{14}_1$, $\mathbf{14}_2$ (see FIG. 7*b*) that project over the frontal surfaces of support body 14*b* slide along the convex outer surface 20*a* of the sliding guide 20 in the direction of arrow D (see FIG. 2). The clothing strip 18 is attached to the underside of the support body 14*b.* Wire points 19' of the flat bar clothing 19 (see FIG. 3*b*) define a circle 21 (see FIG. 2). The main carding cylinder 4 is provided with cylinder clothing 4*a,* for example, a sawtooth clothing, along its circumference. The points of the main carding cylinder clothing 4*a* define a circle 22. A distance a between the circle of points 21 and the circle of points 22 can be, for example, 3/1000". The distance between the convex outer surface 20*a* and the circle of points 22 is indicated by reference character b, while the distance between the convex outer surface 20*a* and the circle of points 21 is indicated by reference character c. The radius for the convex outer surface 20*a* is $r_1$ and the radius for the circle of points 22 is $r_2$. The radii $r_1$ and $r_2$ intersect at the center M of the main carding cylinder 4.

Figure 3B:
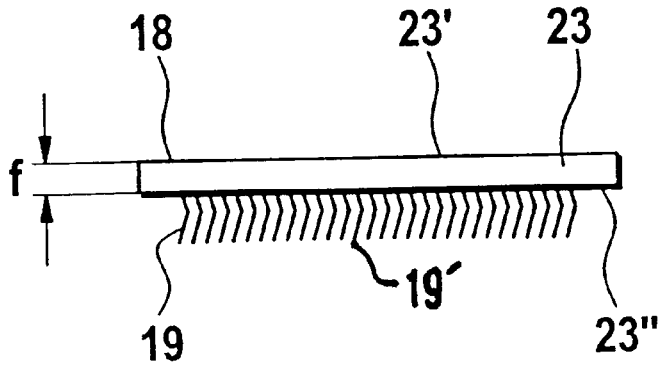
FIG. 3*b* is a side elevation view through a clothing strip.
Figure 3C:
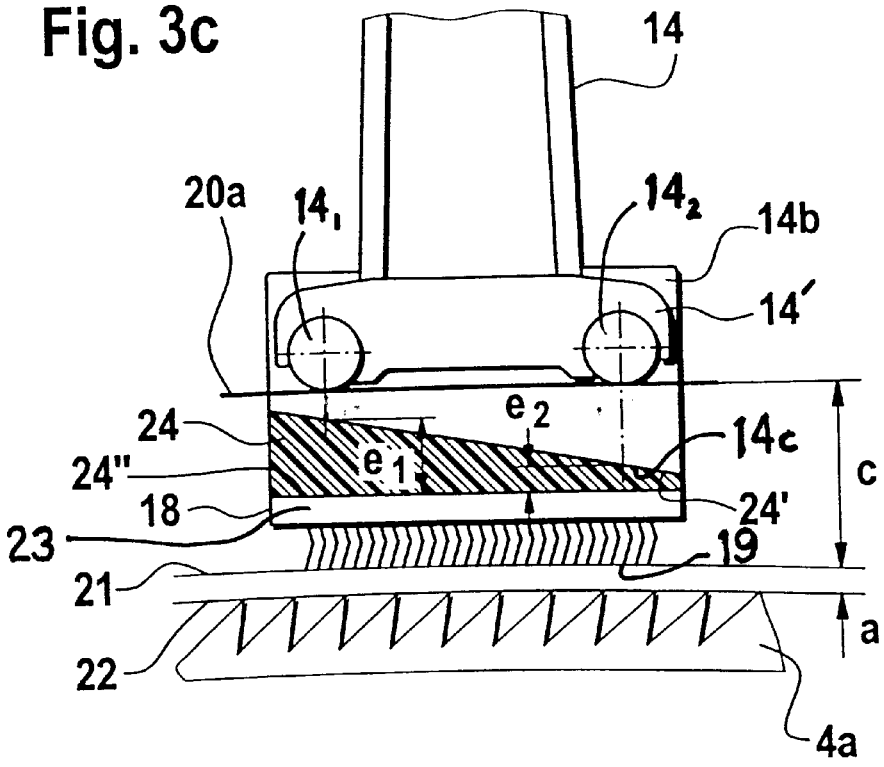
FIG. 3*c* is a side elevation view of a flat bar and a clothing strip according to FIGS. 3*a* and 3*b,* assembled and including an equalizing layer.

FIG. 3*a* shows (exaggerated in the drawings) that the vertical distance $d_1$, between the sliding point of pin $\mathbf{14}_1$ and the underside 14*c*, and the vertical distance $d_2$, between the sliding point of pin $\mathbf{14}_2$ and the underside 14*c*, are different. This difference results in the underside 14*c* being arranged at angle α relative to the vertical center line 35 through the support body 14*b*. As shown in FIG. 3*b*, the clothing strip 18 consists of clothing wire points 19' (wire hooks) and a support element 23 of, for example, a textile material. The support element 23 has an upper surface 23', a lower surface 23", and a thickness f. The clothing wires 19 project with one end through the lower surface 23", and are fastened to the support element 23. The other ends of the clothing wires 19, the clothing wire points 19', are free. As shown in FIG. 3*c*, an intermediate layer 24, e.g., consisting of hardened synthetic resin, is arranged between the support body 14*b* and the support element 23. The top surface 24' of intermediate layer 24 is positioned such that it makes contact with the underside 14*c* of support body 14*b*. Lower surface 24" of intermediate layer 24 is positioned such that it makes contact with the upper surface 23' of the support element 23. The top surface 24' is also arranged at the angle α relative to the vertical center line 35 through the support body 14*b*. The lower surface 24" is oriented parallel to the connecting line between the sliding points for pins $\mathbf{14}_1$, $\mathbf{14}_2$ and a tangent of the circle of points 21. As a result, the distance c between the sliding points for pins $\mathbf{14}_1$, $\mathbf{14}_2$ (on the sliding surface 20*a*) and the circle of points 21 is the same for both pins $\mathbf{14}_1$, $\mathbf{14}_2$. The equalizing layer 24 equalizes the distance differences $e_1$, $e_2$ between the surfaces 14*c* and 23'. Thus, despite the undesirable slanted course of the underside 14*c* of support body 14*b*, the important and narrow carding distance a between the circle of points 21 on the flat bar clothing 19 and the circle of points 22 on the main carding cylinder clothing 4*a* remains constant for all locations. A connecting element 14' is attached to the pins $\mathbf{14}_1$, $\mathbf{14}_2$.

The equalizing layer 24 also equalizes local irregularities on the underside 14*c* of support body 14*b* and/or the upper surface 23' of support element 23. The equalizing layer 24 also equalizes deviations in the distances between the circle of points 21 and the upper surface 23' and/or the lower surface 23".

Figure 4:
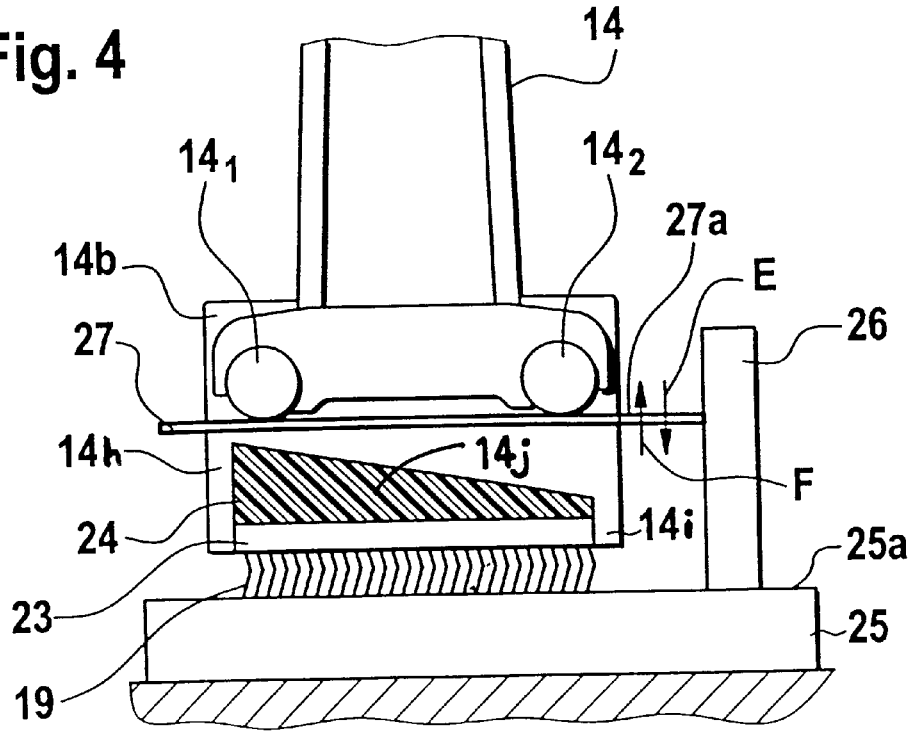
FIG. 4 shows a device with two reference planes for orienting the flat bar to install the equalizing layer.

According to FIG. 4, two ridges 14*h*, 14*i* are attached to the support body 14*b* on the side in a longitudinal direction. These can be welded on, for example, so that a recess 14*j* is created in the region of the underside 14*c*. As a result, the flat bar clothing 18 is protected and embedded.

For the production of clothed flat bar 14, the flat bar wire points 19' of the clothing strip 18 are placed onto a level surface 25*a* of a metal plate 25, for example, a magnetic plate. The flat bar heads 14', 14" with pins $\mathbf{14}_1$, $\mathbf{14}_2$, $\mathbf{14}_3$, $\mathbf{14}_4$ are then placed onto a top surface 27*a* of an adhering holding element 27, e.g., a flat iron or the like. Following this, the adhering equalizing layer 24 is deposited on the upper surface 23' of support element 23. Finally, the holding element 27 is lowered (defined in the direction of arrow E) on the bearing element 26 by means of a drive (not shown herein) and onto the equalizing layer 24. The drive can also raise holding element 27 in the direction of arrow F. In the process, the bottom surface 14*c* is glued to the top surface 24' (see FIG. 3*c*). If necessary, pressure can additionally be exerted via the bottom surface 14*c* onto the top surface 24' by, for example, exerting pressure onto the support body 14*b* or the back piece 14*a*.

Figure 5:
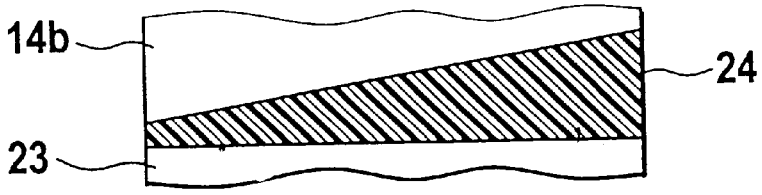
FIG. 5 shows a self-gluing equalizing layer.

FIG. 5 shows an example of an adhesive equalizing layer 24 made of a voluminous adhesive tape, or the like, which can be compressed differently with respect to its height. The adhesive tape is adhesive on two sides, meaning it adheres to the underside 14*c* of support body 14*b* and the upper surface 23' of support element 23.

Figure 6:
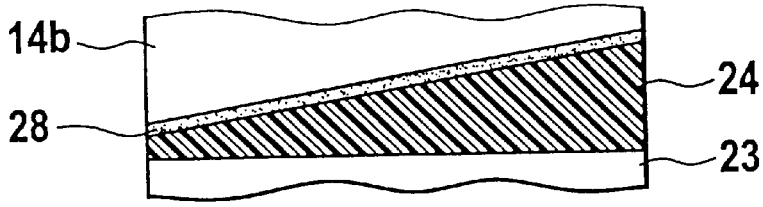
FIG. 6 shows an adhesive strip between the support body and the equalizing layer.

FIG. 6 shows a thinner adhesive tape 28 provided between the support body 14*b* and the equalizing layer 24. The strip can adhere with one side to the underside 14*c* or with two sides to the underside 14*c* and the top surface 24'. The equalizing layer 24 can be fixed to the support element 23, if necessary, such that it cannot be detached. The advantage of the adhesive strip 28 is that the connection between support body 14*b* and the equalizing layer 24 can be broken easily for replacing the clothing strip 18 by, for example, simply pulling off the adhesive strip 28. This allows a clothing strip 18, with worn-out clothing 19, the support element 23, the equalizing layer 24, and the adhesive strip 28, to be simply discarded and replaced.

Figure 7A:
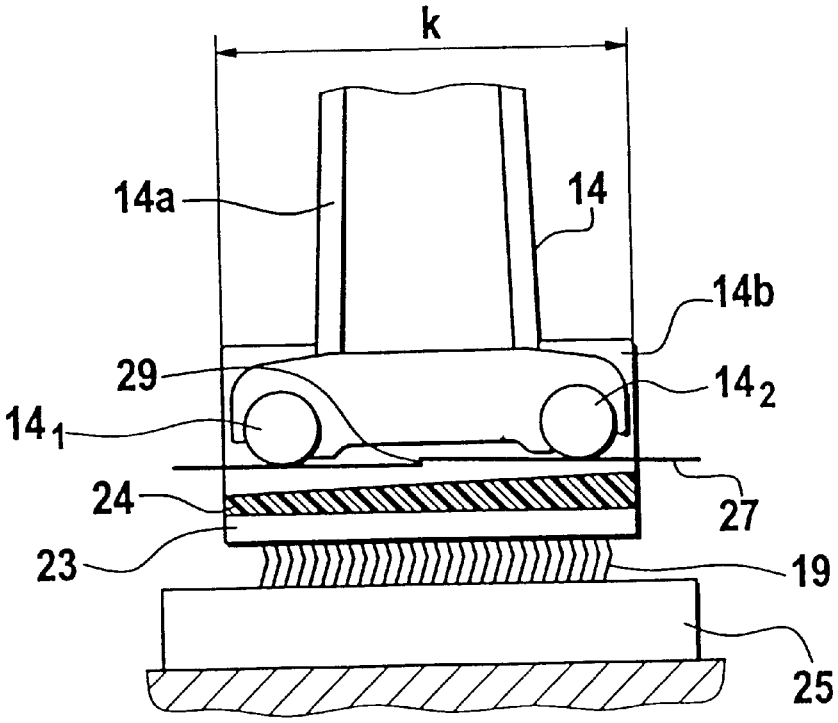
FIG. 7*a* is a side elevation view of another embodiment of the invention.
Figure 7B:
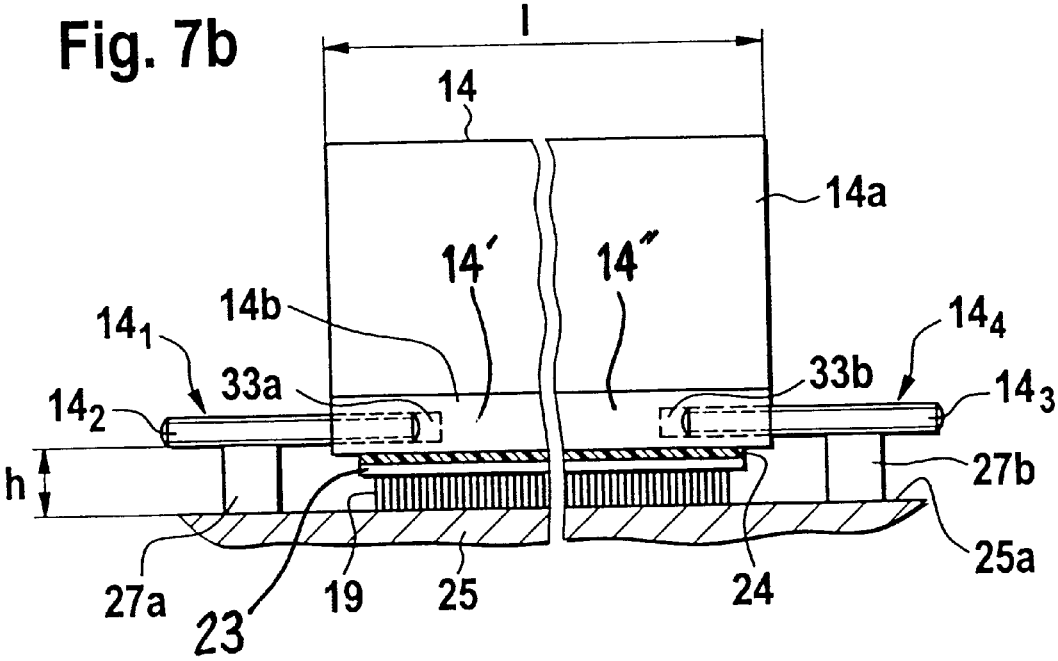
FIG. 7*b* is a partial front elevation view of the embodiment shown in FIG. 7*a;*

FIG. 7*a* shows the holding element 27, provided with a small step 29 (of, for (example, 0.4 mm) between the pins $\mathbf{14}_1$ and $\mathbf{14}_2$, designed to balance the so-called rack. FIG. 7*b* shows that a square support element 27*a* with parallel and level surfaces and a height h is arranged between the flat bar pins $\mathbf{14}_1$, $\mathbf{14}_2$ and the plate 25. An additional square support element 27*b* with the same height h is arranged between the flat bar pins $\mathbf{14}_3$, $\mathbf{14}_4$ and the plate 25. Elements 27*a*, 27*b* are fixed locally onto the plate 25. With this device and additional ridge elements on the side (not shown herein) or the like (e.g. movable limiting surfaces for the equalizing layer 24 and/or the support element 23), the clothing wire points 19' of the clothing strip 18 can be positioned on the plate 25, and the flat bar 14, with pins $\mathbf{14}_1$, $\mathbf{14}_2$, $\mathbf{14}_3$, $\mathbf{14}_4$, can be positioned on the support elements 27*a*, 27*b*. The equalizing layer 24 is subsequently inserted between the support body 14*b* and the support element 23. This layer can be inserted, for example, by pouring it in, injecting it, inserting it, manually applying it, or the like. The equalizing layer 24, which may have the consistency of dough, spreads through and fills the intermediate space.

A solid equalizing layer 24, e.g., a plastic strip, that is initially connected securely to the support element 23 can also be used. With such a solid equalizing layer, the support body 14*b* is placed, if necessary, under pressure, onto the equalizing layer 24. In the process, the support body can be heated so that the equalizing layer 24 is melted onto the underside 14*c*. The underside 14*c* can be structured, for example, with recesses, raised areas, holes, or the like, for attaching the equalizing layer 24. The underside 14*c* of the support body 14*b* can be heated up using different methods, e.g., inductively or contact heat.

Figure 8:
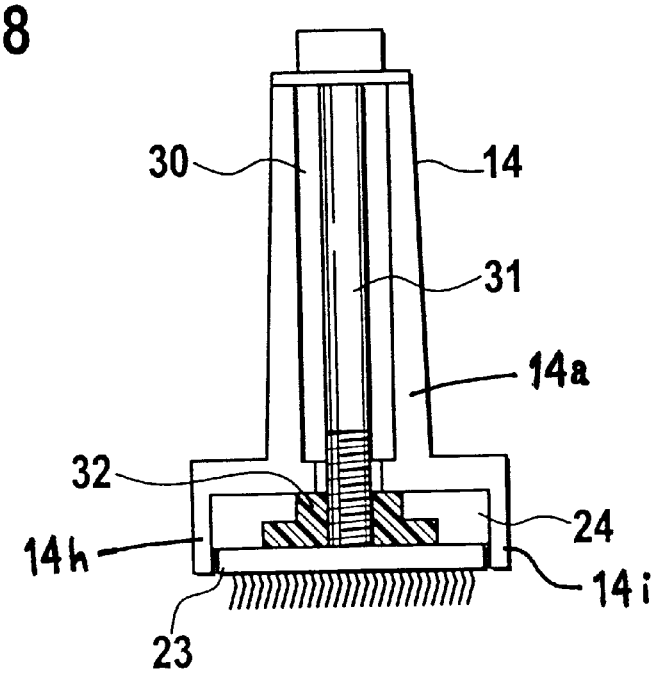
FIG. 8 shows an embodiment of the invention with a fastening plate.

According to another embodiment of the invention, as shown in FIG. 8, the flat bar 14 that is provided with side ridges 14*h*, 14*i* on the underside is used as a casting mold. For example, casting resin is poured between the flat bar 14 and the clothing strip 18. The back piece 14*a* of the flat bar 14 is provided with several bores 30 across its length. Screws 31 extend through these bores and engage in threads in fastening plates 32, made, for example, of metal. The flat bar 14 is provided with a separation means before the resin is poured in, so that that the clothing strip 18 can be replaced once it is worn.

Figure 9:
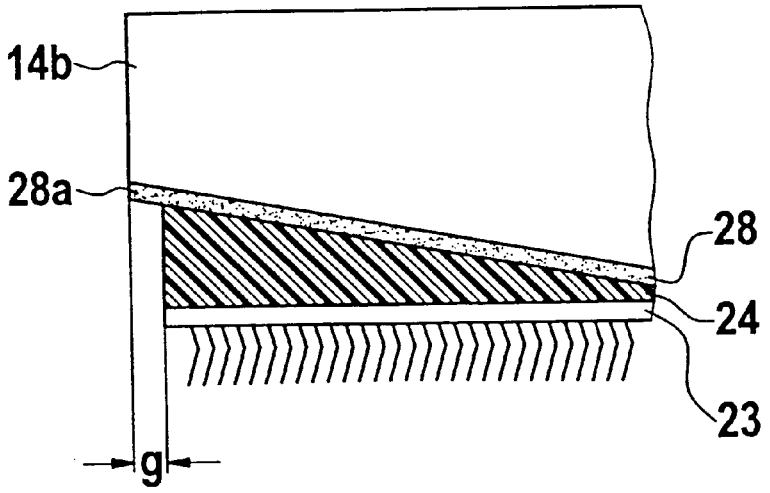
FIGS. 9 and 10 show an embodiment of the invention with an extended adhesive strip.
Figure 10:
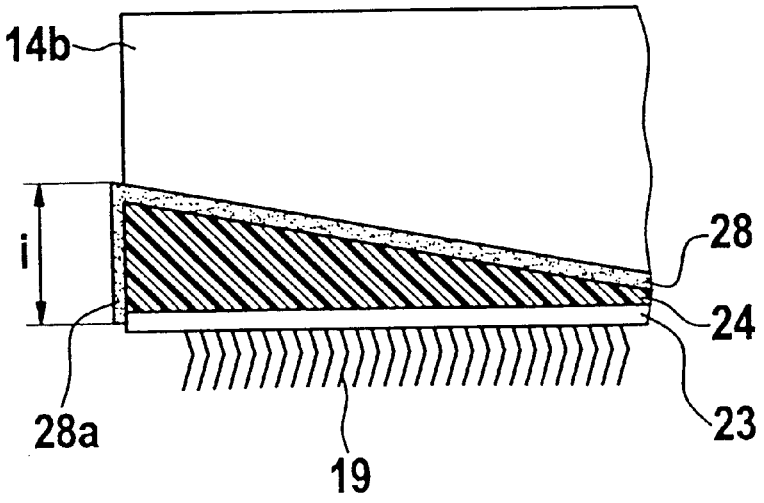

In the embodiments shown in FIGS. 9 and 10, the adhesive strip 28, which can be reinforced with a textile insert (hardened fiberglass or the like), is extended in at least one of its edge regions to match the width k (see FIG. 7*a*) of support body 14*b*, the equalizing layer 24, and/or the support element 23. This forms shackle 28*a*. The shackle 28*a*, the length of which is shown in FIG. 9 as g and in FIG. 10 as i, can be grabbed separately at a later date with the aid of tongs or the like. This facilitates severing the connection between the bottom surface 14*c* and the cooperating surface of the adhesive strip 28, which permits the adhesive strip 28, together with the equalizing layer 24 and the clothing strip 18, to be pulled off or detached from the support body 14*b*.

The invention has been described in detail with respect to preferred embodiments, and it will now be apparent from the foregoing to those skilled in the art, that changes and modifications may be made without departing from the invention in its broader aspects. The invention, therefore, is intended to cover all such changes and modifications that fall within the true spirit of the invention.

What is claimed is:

1. A flat bar assembly for use with a carding machine having a carding cylinder, the carding cylinder having clothing, the assembly comprising:

a flat bar;

flat bar clothing attached to the flat bar; and an equalizing layer between the flat bar and the flat bar clothing, wherein the flat bar clothing is for positioning opposite the carding cylinder clothing, the equalizing layer fills a space between the flat bar and the flat bar clothing, and the equalizing layer is plastically deformable during assembly of the flat bar assembly to compensate for distance differences between the flat bar clothing and the flat bar and to locate the flat bar clothing at a predetermined position relative to the flat bar.

2. The assembly of claim 1, wherein the flat bar clothing further comprises a back piece, the flat bar further comprises a bottom surface, and the equalizing layer fills a space between the back piece and the bottom surface and compensates for distance differences between the back piece and the bottom surface and thus establishes the predetermined position.

3. The assembly of claim 2, wherein the equalizing layer conforms to irregularities in the back piece and the bottom surface for equalizing distance differences between the back piece and the bottom surface.

4. The assembly of claim 2, wherein the bottom surface of the flat bar is provided with an equalizing step.

5. The assembly of claim 2, wherein the bottom surface of the flat bar further comprises a recess, and the back piece of the flat bar clothing and the equalizing layer are arranged in the recess.

6. The assembly of claim 2, wherein the equalizing layer is meltable such that the equalizing layer conforms to the bottom surface of the flat bar.

7. The assembly of claim 2, wherein the bottom surface comprises one of a recess, a raised area and a hole.

8. The assembly of claim 1, wherein the equalizing layer is pourable during assembly.

9. The assembly of claim 8, wherein the flat bar further comprises passages through which the equalizing layer is poured.

10. The assembly of claim 1, wherein the flat bar further comprises a bottom surface, a first pin having a first sliding surface, and a second pin having a second sliding surface, the first and second sliding surfaces are for sliding on a sliding guide of the carding machine, the equalizing layer further comprises a lower surface, a sliding direction is defined as a direction that is tangent to both the first and second sliding surfaces, a first distance is defined as a distance between the first sliding surface and the lower surface of the equalizing layer in a direction perpendicular to the sliding direction, and a second distance is defined as a distance between the second sliding surface and the lower surface of the equalizing layer in the direction perpendicular to the sliding direction, and the first distance is substantially equal to the second distance, thus establishing the predetermined position.

11. The assembly of claim 10, wherein the flat bar further comprises two head pieces.

12. The assembly of claim 11, wherein the two head pieces further comprise the first and second pins.

13. The assembly of claim 12, wherein the first and second pins are fastened within recesses in the two head pieces.

14. The assembly of claim 1, wherein the flat bar further comprises a first pin having a first sliding surface and a second pin having a second sliding surface, the first and second sliding surfaces are for sliding on a sliding guide of the carding machine, the sliding guide having a predetermined orientation relative to the carding cylinder clothing, the flat bar clothing further comprises clothing ends, a sliding direction is defined as a direction that is tangent to both the first and second sliding surfaces, a first distance is defined as a distance between the first sliding surface and the clothing ends in a direction perpendicular to the sliding direction, and a second distance is defined as a distance between the second sliding surface and the clothing ends in the direction perpendicular to the sliding direction, and the first distance is substantially equal to the second distance.

15. The assembly of claim 1, wherein the equalizing layer has a non-uniform thickness for compensating for distance differences between a circle defined by tips of the flat bar clothing and a circle defined by the carding cylinder clothing.

16. The assembly of claim 1, wherein the flat bar is a part of a set of traveling flats.

17. The assembly of claim 1, wherein the flat bar is a locally fixed carding element.

18. The assembly of claim 1, wherein the equalizing layer comprises a plastic material.

19. The assembly of claim 18, wherein the equalizing layer is deformable such that pressure applied to the flat bar causes the equalizing layer to fill the space between the flat bar and the flat bar clothing.

20. The assembly of claim 1, wherein the equalizing layer is one of a synthetic resin and polyester.

21. The assembly of claim 20, wherein the equalizing layer hardens after placement.

22. The assembly of claim 20, wherein the equalizing layer adheres to one of the flat bar and the flat bar clothing.

23. The assembly of claim 1, further comprising an adhesive layer positioned between the equalizing layer and the flat bar.

24. The assembly of claim 23, wherein the equalizing layer and the adhesive layer are attachable from the flat bar.

25. The assembly of claim 24, wherein the equalizing layer and the adhesive layer are detachable from the flat bar without leaving residue on the flat bar.

26. A flat bar assembly for use with a carding machine having a carding cylinder, the carding cylinder having clothing, the assembly comprising:

a flat bar;

flat bar clothing attached to the flat bar; and an equalizing layer between the flat bar and the flat bar clothing, the equalizing layer being one of a synthetic resin and polyester, wherein the flat bar clothing is for positioning opposite the carding cylinder clothing, the equalizing layer fills a space between the flat bar and the flat bar clothing to compensate for distance differences between the flat bar clothing and the flat bar and to locate the flat bar clothing at a predetermined position relative to the flat bar, and wherein the equalizing layer is pourable during assembly.

27. A flat bar assembly for use with a carding machine having a carding cylinder, the carding cylinder having clothing, the assembly comprising:

a flat bar;

flat bar clothing attached to the flat bar; and an equalizing layer between the flat bar and the flat bar clothing, wherein the flat bar clothing is for positioning opposite the carding cylinder clothing, the equalizing layer fills a space between the flat bar and the flat bar clothing to compensate for distance differences between the flat bar clothing and the flat bar and to locate the flat bar clothing at a predetermined position relative to the flat bar, and the equalizing layer adheres to the flat bar clothing and to the flat bar with an adhesive and the equalizing layer adheres more strongly to the flat bar clothing than to the flat bar.

28. A flat bar assembly for use with a carding machine having a carding cylinder, the carding cylinder having clothing, the assembly comprising:

a flat bar;

flat bar clothing attached to the flat bar;

an equalizing layer between the flat bar and the flat bar clothing; and an adhesive layer positioned between the equalizing layer and the flat bar, the adhesive layer having a shackle that extends beyond one of the flat bar and the equalizing layer, the shackle providing a gripping point for gripping during disassembly of the equalizing layer and adhesive layer from the flat bar, wherein the flat bar clothing is for positioning opposite the carding cylinder clothing, the equalizing layer fills a space between the flat bar and the flat bar clothing to compensate for distance differences between the flat bar clothing and the flat bar and to locate the flat bar clothing at a predetermined position relative to the flat bar, and the equalizing layer and the adhesive layer are detachable from the flat bar.

* * * * *